US007401707B2

(12) United States Patent
Brozell et al.

(10) Patent No.: US 7,401,707 B2
(45) Date of Patent: Jul. 22, 2008

(54) CHILD-RESISTANT CLOSURE HAVING A NON-CHILD-RESISTANT MODE OF OPERATION

(75) Inventors: Brian J. Brozell, Maumee, OH (US); Steven R. Wolfe, Maumee, OH (US)

(73) Assignee: Rexam Prescription Products Inc., Perrysburg, OH (US)

( * ) Notice: Subject to any disclaimer, the term of this patent is extended or adjusted under 35 U.S.C. 154(b) by 160 days.

(21) Appl. No.: 11/313,047

(22) Filed: Dec. 20, 2005

(65) Prior Publication Data

US 2006/0108313 A1 May 25, 2006

Related U.S. Application Data

(63) Continuation of application No. 10/756,082, filed on Jan. 13, 2004, now abandoned.

(51) Int. Cl.
*B65D 41/20* (2006.01)
*B65D 41/00* (2006.01)

(52) U.S. Cl. ..... 215/220; 215/219; 215/230; 215/232

(58) Field of Classification Search ..... 215/204, 215/216–221, 223, 228, 230, 232, 274, 334; 206/459.5
See application file for complete search history.

(56) References Cited

U.S. PATENT DOCUMENTS 2,847,139 A 8/1958 Christiansson et al.
3,756,444 A 9/1973 McIntosh
3,797,688 A 3/1974 Porcelli et al.

(Continued)

FOREIGN PATENT DOCUMENTS

GB 1529999 10/1978

(Continued)

OTHER PUBLICATIONS

Owens-Illinois Brochure, "Argus-Loc Closures" (1 page), Drawing (Mar. 2000) and Photograph of prior art Argus-Loc closure.

*Primary Examiner*—Robin Hylton
(74) *Attorney, Agent, or Firm*—Reising, Ethington, Barnes, Kisselle, P.C.

(57) ABSTRACT

A closure includes an outer plastic shell having a base wall, a peripheral skirt with a central axis, a circumferential array of lugs on an underside of the base wall, and a pair of axially spaced internal beads on the skirt spaced from the base wall. An inner plastic shell has a base wall, a peripheral skirt with a central axis, at least one internal thread on the skirt of the inner shell, a circumferential array of lugs on an outer surface of the base wall, and a circumferential bead on an outer surface of the skirt remote from the base wall. The inner shell is positionable within the outer shell in a non-child-resistant first position with the bead on the skirt of the inner shell captured between the beads on the skirt of the outer shell, such that the outer shell is rotatably coupled to the inner shell and the at least one internal thread on the skirt of the inner shell can be threaded onto and off of a container by simple rotation of the outer shell. The inner shell is positionable within the outer shell in a child-resistant second position with the bead on the inner shell skirt spaced from the beads on the outer skirt, such that rotation of the outer shell is imparted to the inner shell by forced engagement of the lugs on the base wall.

3 Claims, 9 Drawing Sheets

U.S. PATENT DOCUMENTS

| | | | | | |
|---|---|---|---|---|---|
| 3,853,236 | A | | 12/1974 | Ostrowsky | |
| 3,924,770 | A | | 12/1975 | Scuderi | |
| 3,946,890 | A | | 3/1976 | Scuderi | |
| 4,011,960 | A | | 3/1977 | Mauvernay et al. | |
| 4,270,644 | A | | 6/1981 | Billet | |
| 4,271,971 | A | | 6/1981 | Morris | |
| 4,364,484 | A | | 12/1982 | Kinsley | |
| 4,433,789 | A | | 2/1984 | Gibilisco | |
| 4,669,620 | A | * | 6/1987 | Coifman | 215/220 |
| 4,729,487 | A | | 3/1988 | Wright | |
| 4,957,210 | A | | 9/1990 | Kusz | |
| 4,997,096 | A | | 3/1991 | Kusz | |
| 5,005,718 | A | | 4/1991 | Buono | |
| 5,020,681 | A | | 6/1991 | Kusz | |
| 5,115,928 | A | | 5/1992 | Drummond, Jr. | |
| 5,115,929 | A | | 5/1992 | Buono | |
| 5,147,052 | A | * | 9/1992 | Minette | 215/215 |
| 5,184,739 | A | | 2/1993 | Kusz | |
| 5,188,251 | A | | 2/1993 | Kusz | |
| 5,197,616 | A | | 3/1993 | Buono | |
| 5,370,251 | A | | 12/1994 | Buono | |
| RE34,930 | E | | 5/1995 | Kusz | |
| 5,445,283 | A | | 8/1995 | Krautkramer | |
| 5,513,780 | A | | 5/1996 | Buono | |
| 5,579,934 | A | | 12/1996 | Buono | |
| 5,588,545 | A | | 12/1996 | King | |
| 5,590,799 | A | | 1/1997 | King | |
| 5,609,262 | A | | 3/1997 | Trout | |
| 5,611,443 | A | | 3/1997 | King | |
| 5,749,484 | A | | 5/1998 | Trout | |
| 5,762,215 | A | * | 6/1998 | Ogden | 215/220 |
| 5,865,330 | A | | 2/1999 | Buono | |
| 6,206,216 | B1 | * | 3/2001 | Stalions | 215/220 |
| 2002/0027119 | A1 | | 3/2002 | Miceli et al. | |
| 2002/0027120 | A1 | | 3/2002 | Miceli et al. | |

FOREIGN PATENT DOCUMENTS

| | | |
|---|---|---|
| GB | 2138410 | 10/1984 |
| GB | 2141697 | 1/1985 |
| GB | 2205821 | 12/1988 |
| GB | 2236308 | 4/1991 |
| GB | 2264291 | 8/1993 |
| WO | PCT/US2005/001190 | 1/2005 |

* cited by examiner

CHILD-RESISTANT CLOSURE HAVING A NON-CHILD-RESISTANT MODE OF OPERATION

This application is a continuation of U.S. patent application Ser. No. 10/756,082 filed Jan. 13, 2004, now abandoned.

The present invention relates to child-resistant closures.

BACKGROUND AND SUMMARY OF THE INVENTION

U.S. Pat. No. 4,997,096 discloses a child-resistant closure having inner and outer plastic shells. The outer plastic shell has a base wall, a peripheral skirt and a circumferential array of lugs on an underside of the base wall. The inner shell has a base wall, a peripheral skirt, at least one internal thread on the skirt, and a circumferential array of lugs on an outer surface of the base wall for opposed engagement by the internal lugs on the base wall of the outer shell. To remove the closure when it is threaded onto a container finish, the outer shell must be pushed axially against the inner shell and simultaneously rotated so that the lugs of the outer shell engage the lugs of the inner shell and rotate the inner shell with respect to the container finish. When the outer shell is rotated without applying an axial force to the outer shell, the lugs on the outer shell simply cam over the lugs on the inner shell and do not rotate the inner shell with respect to the container finish. Child-resistant closures of the type illustrated in this patent have been marketed for many years by applicants' assignee under the trademark ARGUS-LOC. See also GB 1529999. In some instances, child-resistant packaging is not required, and it is a general object of the present invention to provide a closure of the type disclosed in the above-noted U.S. patent that possesses a non-child-resistant mode of operation in which the closure can be readily removed from a container finish.

A closure in accordance with the present invention includes an outer plastic shell having a base wall, a peripheral skirt with a central axis, a circumferential array of lugs on an underside of the base wall, and a pair of axially spaced internal beads on the skirt spaced from the base wall. An inner plastic shell has a base wall, a peripheral skirt with a central axis, at least one internal thread on the skirt of the inner shell, a circumferential array of lugs on an outer surface of the base wall, and a circumferential bead on an outer surface of the skirt remote from the base wall. The inner shell is positionable within the outer shell in a non-child-resistant first position with the bead on the skirt of the inner shell captured between the beads on the skirt of the outer shell, such that the outer shell is rotatably coupled to the inner shell and the at least one internal thread on the skirt of the inner shell can be threaded onto and off of a container by simple rotation of the outer shell. The inner shell is positionable within the outer shell in a child-resistant second position with the bead on the inner shell skirt spaced from the beads on the outer skirt, such that rotation of the outer shell is imparted to the inner shell by forced engagement of the lugs on the base walls.

In the preferred embodiments of the invention, the internal bead on the outer shell skirt further from the base wall of the outer shell has a lesser internal diameter than the internal bead closer to the base wall of the outer shell, and cooperates with the external bead on the inner shell to retard removal of the inner shell from within the outer shell. The base wall of the outer shell preferably has an opening into which a dome on the inner shell extends in the child-resistant position of the inner shell with respect to the outer shell. This dome helps facilitate manual movement of the inner shell from the child-resistant to the non-child-resistant position, and helps prevent entry of debris through the opening of the outer shell in the child-resistant position.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

Figure 1:
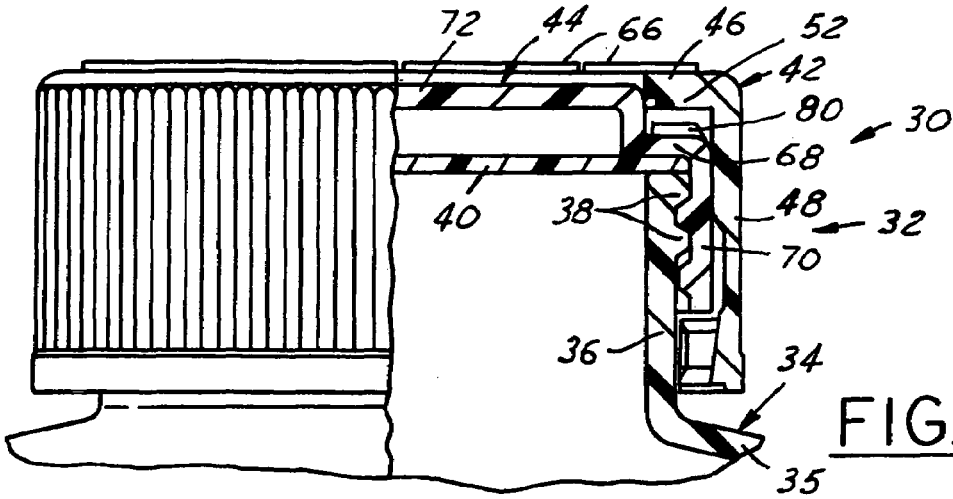
FIG. 1 is a partially sectioned fragmentary elevational view of a child-resistant closure and container package in accordance with one presently preferred embodiment of the invention.

FIG. 1 illustrates a package 30 that includes container 34 and a closure 32 in accordance with one presently preferred embodiment of the invention. Container 34 includes a body 35 and cylindrical finish 36 having one or more external threads 38 for securement of closure 32. A liner disk 40 is positioned on the upper or sealing surface of finish 36. Liner disk 40 may be of any suitable monolayer or multilayer construction, and may be loosely positioned on finish 36, or more preferably removably secured to finish 36 by heat sealing or the like.

Figure 5:
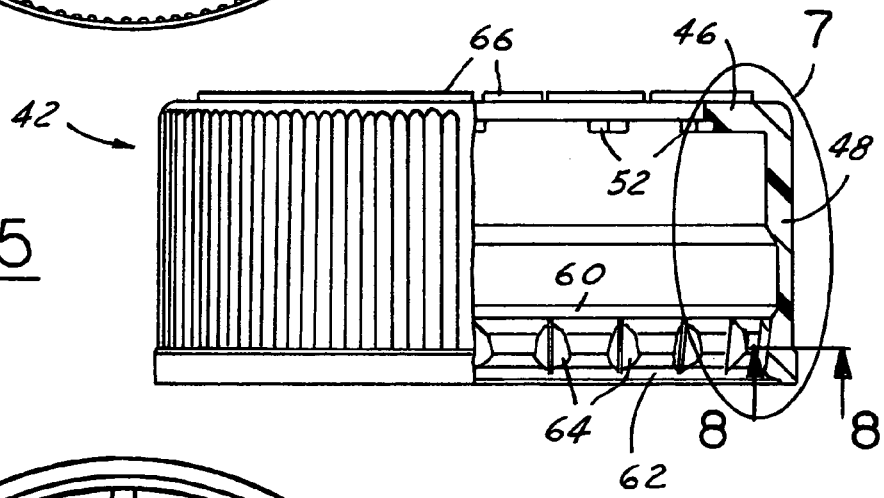
FIG. 5 is a partially sectioned elevational view of the outer shell in the closure of FIGS. 1-3.
Figure 6:
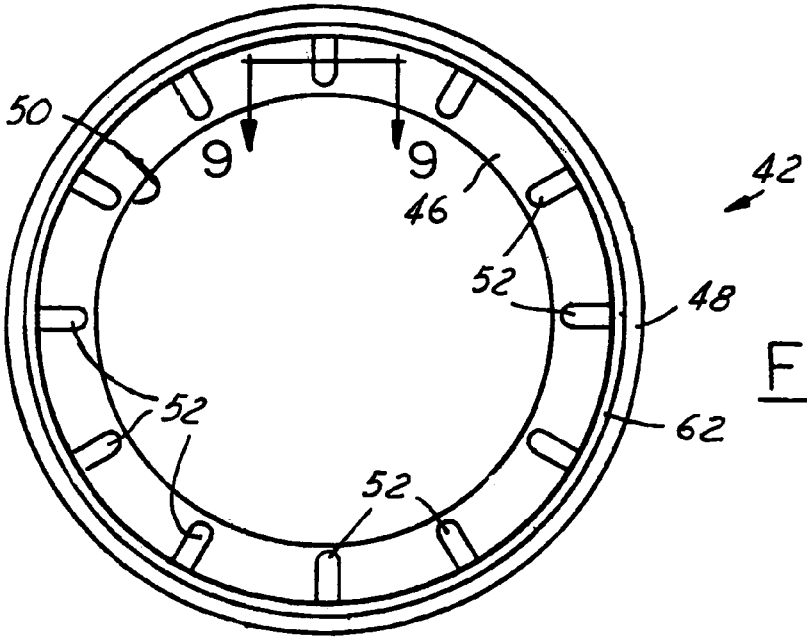
FIG. 6 is a bottom plan view of the outer shell in the closure of FIGS. 1-3.

FIGS. 1-15 illustrate closure 32 in accordance with one presently preferred embodiment of the invention. Closure 32 preferably is an assembly of a one-piece integrally molded outer plastic shell 42 and a one-piece integrally molded inner plastic shell 44. Outer shell 42 (FIGS. 1-10) includes a base wall 46 with a cylindrical skirt 48 extending from the outer peripheral edge of base wall 46. Base wall 46 preferably is flat and annular in construction, having an inner periphery that defines a circular opening 50 through the base wall. A circumferential array of lugs 52 are disposed on the underside of base wall 46 between opening 50 and skirt 48. Each lug 52 is generally rectangular in cross section (FIG. 9) having a flat axially facing end wall 54 and circumferentially facing sidewalls 56, 58. The end walls 54 of the several lugs 52 preferably lie in a plane parallel to base wall 46 and perpendicular to the central axis of closure skirt 48. As viewed from the axial direction (FIG. 6), lugs 52 extend radially along the undersurface of base wall 46. Sidewalls 56, 58 are flat, and are parallel to each other on each lug. The radially inner ends of lugs 52 are rounded, as best seen in FIG. 6.

Figure 7:
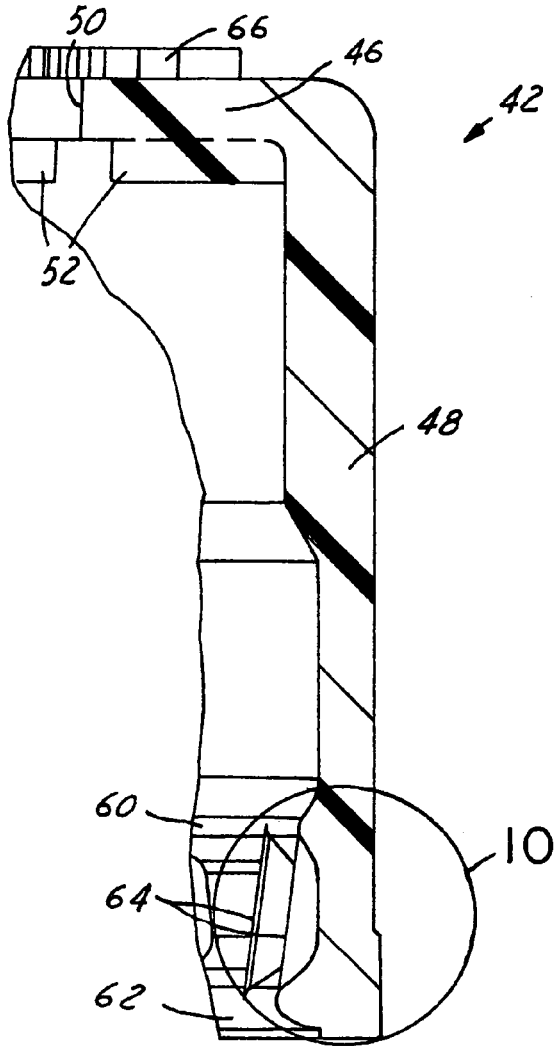
FIG. 7 is an enlarged fragmentary sectional view of the portion of FIG. 5 within the area 7.
Figure 8:
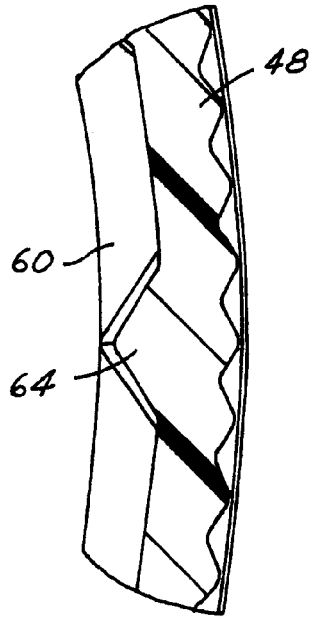
FIG. 8 is a fragmentary sectional view taken substantially along the line 8-8 in FIG. 5.
Figure 9:
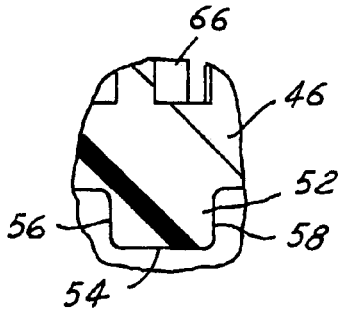
FIG. 9 is a fragmentary sectional view taken substantially along the line 9-9 in FIG. 6.
Figure 10:
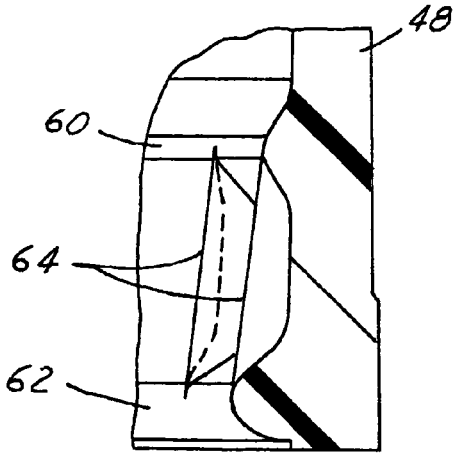
FIG. 10 is a fragmentary sectional view on an enlarged scale of the portion of FIG. 7 within the area 10.

A pair of axially spaced internal beads 60, 62 are disposed on skirt 48 adjacent to the edge of the skirt remote from base wall 46. In the embodiment of FIGS. 1-15, internal beads 60, 62 are circumferentially continuous. Internal bead 62 remote from base wall 46 has an inside diameter which is less than that of internal bead 60 closer to base wall 46, for reasons to be described. An array of circumferentially spaced ribs 64 extend axially between beads 60, 62 on the inside of skirt 48. Ribs 64 are generally triangular in construction as viewed from the axial direction, and as best seen in FIG. 8. The radially inner edges of ribs 64 blend with the innermost edges of beads 60, 62, as best seen in FIGS. 5, 7 and 10, and therefore are angulated in the preferred embodiment of the invention between the upper rib 60 of greater inner diameter and the lower rib 62 of lesser inner diameter. (Directional words such as "upper" and "lower" are employed by way of description and not limitation with respect to the upright orientation of the closure assembly illustrated in FIGS. 1-3. Directional words such as "circumferential" and "radial" are employed by way of description and not limitation with respect to the central axes of the inner and outer shell skirts as applicable.) Indicia 66 preferably are provided around the external surface of base wall 46 to instruct a user how to remove and apply the closure to container 34 (FIG. 1). Such indicia 66 preferably is raised and integrally molded with outer shell 42 as illustrated in the drawings. As an alternative, the indicia may be integrally molded and recessed with respect to the surface of base wall 46, or may be printed on the outer surface of base wall 46 in a post-molding operation. As an additional but less preferred modification, the instructions may be molded or printed on inner shell 44.

Figure 11:
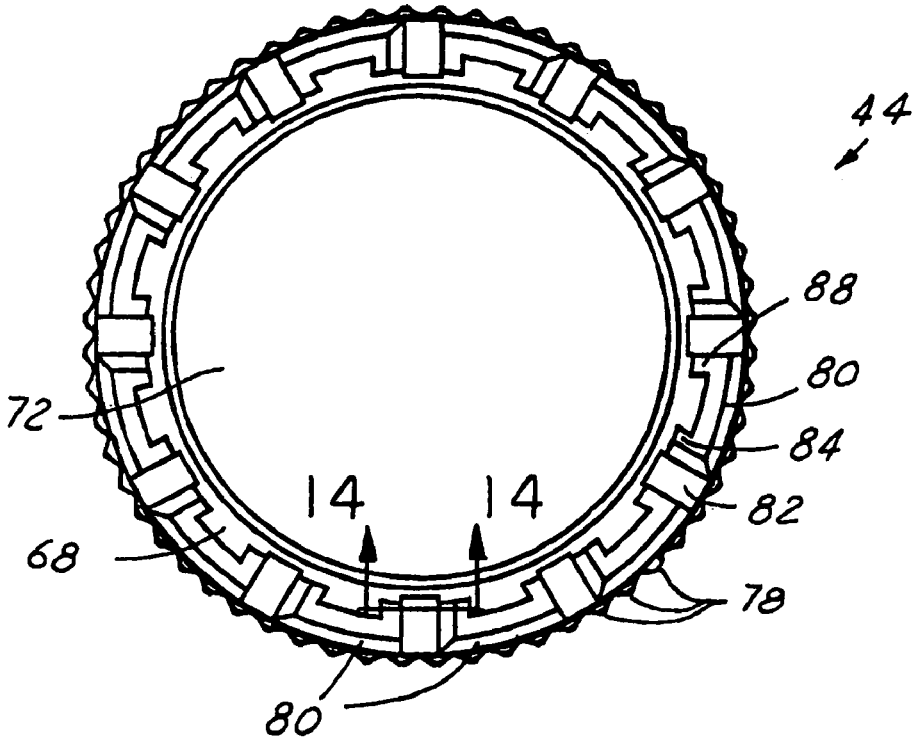
FIG. 11 is a top plan view of the inner shell in the closure of FIGS. 1-3.
Figure 12:
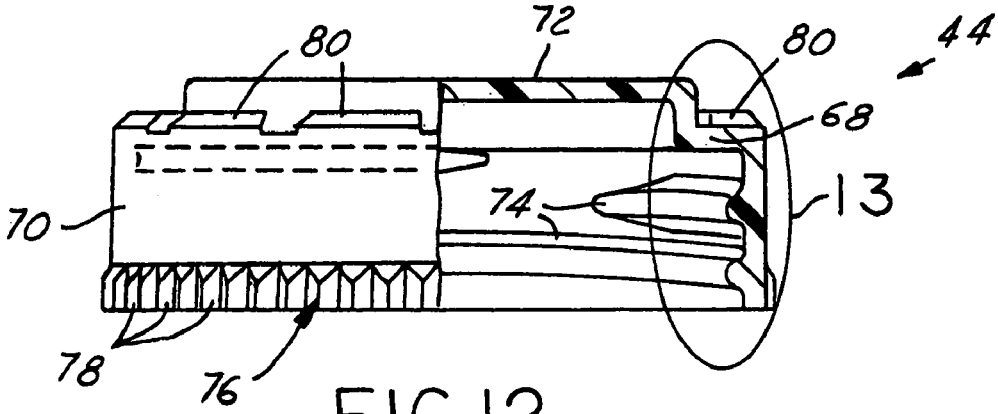
FIG. 12 is a partially sectioned elevational view of the inner shell of FIG. 11.
Figure 13:
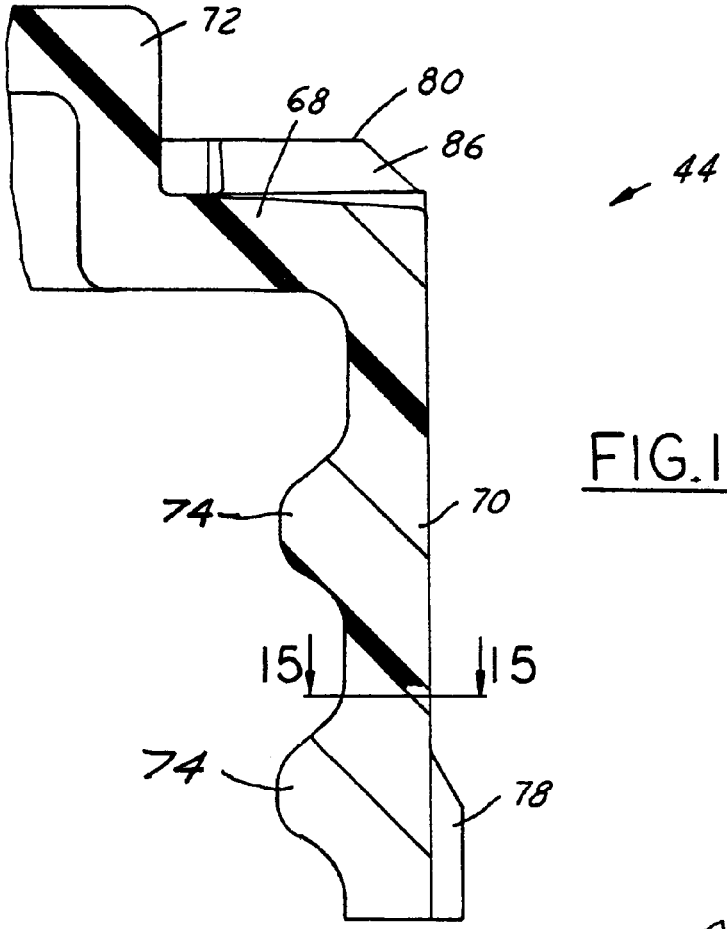
FIG. 13 is a fragmentary sectional view on an enlarged scale of the portion of FIG. 12 within the area 13.
Figure 14:
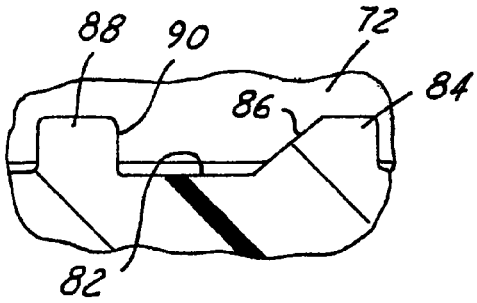
FIG. 14 is a fragmentary sectional view taken substantially along the line 14-14 in FIG. 11.
Figure 15:
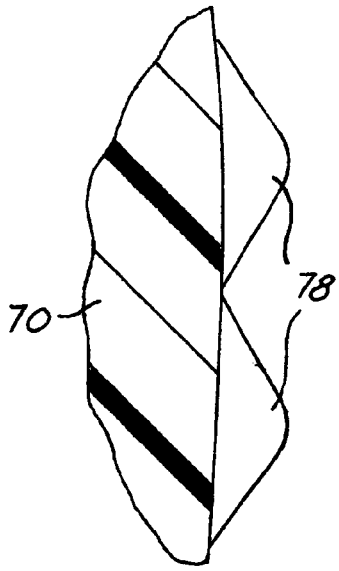
FIG. 15 is a fragmentary sectional view taken substantially along the line 15-15 in FIG. 13.

FIGS. 11-15 illustrate inner closure shell 44 in greater detail. Inner shell 44 includes a base wall 68 having an outer periphery from which a cylindrical skirt 70 extends. In the preferred embodiment of FIGS. 1-15, base wall 68 is annular, and has a projection, preferably in the form of a hollow dome 72, extending axially from the inner periphery of the base wall. Dome 72 extends in a direction opposite from skirt 70 and is coaxial with skirt 70. Skirt 70 has one or more internal threads 74 for receipt over external threads 38 (FIG. 1) on container 34. An external bead 76 extends around skirt 70 at a position adjacent to the edge of the skirt remote from base wall 68. Bead 76 in the embodiment of FIGS. 11-15 includes a circumferential array of axially extending radial teeth 78. Teeth 78 preferably are substantially triangular as viewed from the axial direction, as best seen in FIGS. 11-12 and 15. A circumferential array of external lugs 80 are disposed around the upper surface of base wall 68. Each lug 80 is substantially C-shaped as viewed from the axial direction (FIG. 11), and lugs 80 are separated from each other by inter-lug spaces or gaps 82. Each C-shaped lug 80 has a clockwise-facing leg 84 with a sloping cam surface 86. Each lug 80 also has a counterclockwise-facing leg 88 with a circumferentially facing abutment surface 90 disposed substantially in a plane parallel to the axis of the closure shell. Surfaces 90, 86 are separated by gap 82.

Figure 2:
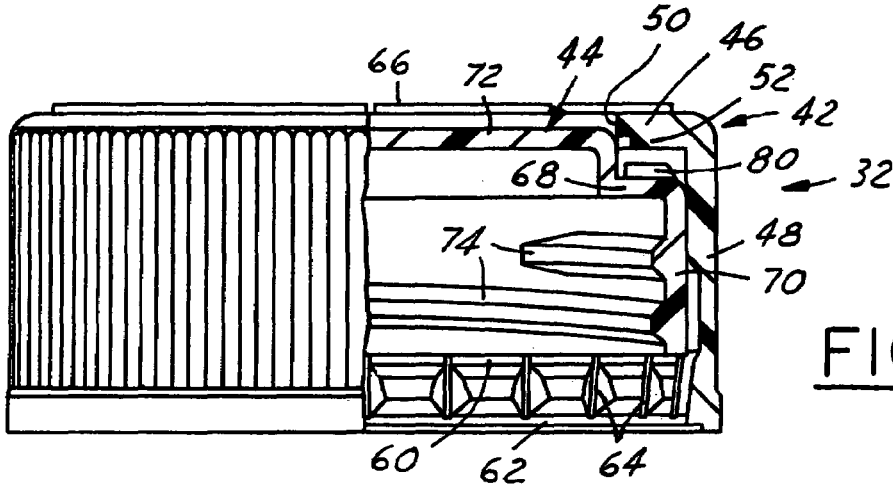
FIG. 2 is a partially sectioned elevational view of the closure in FIG. 1 in a child-resistant mode of operation.

Closure 32 is illustrated in the child-resistant mode of operation in FIGS. 1 and 2, with inner shell 44 in the child-resistant position with respect to outer shell 42. In this position, inner shell 44 is telescopically received within outer shell 42 with external bead 76 on inner shell 44 disposed above upper internal bead 60 of outer shell 42. In this position, inner shell 44 is movable with respect to outer shell 42 between an upper position in which outer shell lugs 52 engage inner shell base wall 68, and a lower position in which inner shell bead 76 engages outer shell upper bead 60. If outer shell 42 is merely rotated counterclockwise with respect to inner shell 44, outer shell lugs 52 on outer shell base wall 46 cam over surfaces 86 on inner shell lugs 80, and removal torque is not applied to the inner shell. However, if outer shell 42 is pressed downwardly onto inner shell 44 simultaneous with rotation in the counterclockwise direction, outer shell lugs 52 engage inner shell lugs 80 and rotate the inner shell in the counterclockwise or opening direction with respect to container finish 36. To secure the closure onto the container finish, outer shell 42 is rotated in the clockwise direction so that outer shell lugs 52 engage abutment faces 90 on inner shell lugs 80 and rotate the inner shell in a clockwise direction to tighten the closure onto the container finish.

Figure 3:
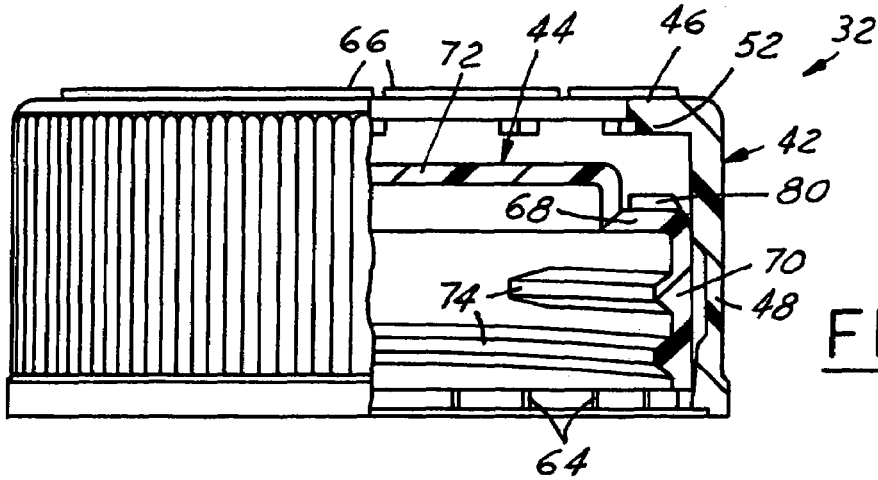
FIG. 3 is a partially sectioned elevational view of the closure in FIG. 1 in a non-child-resistant mode of operation.
Figure 4:
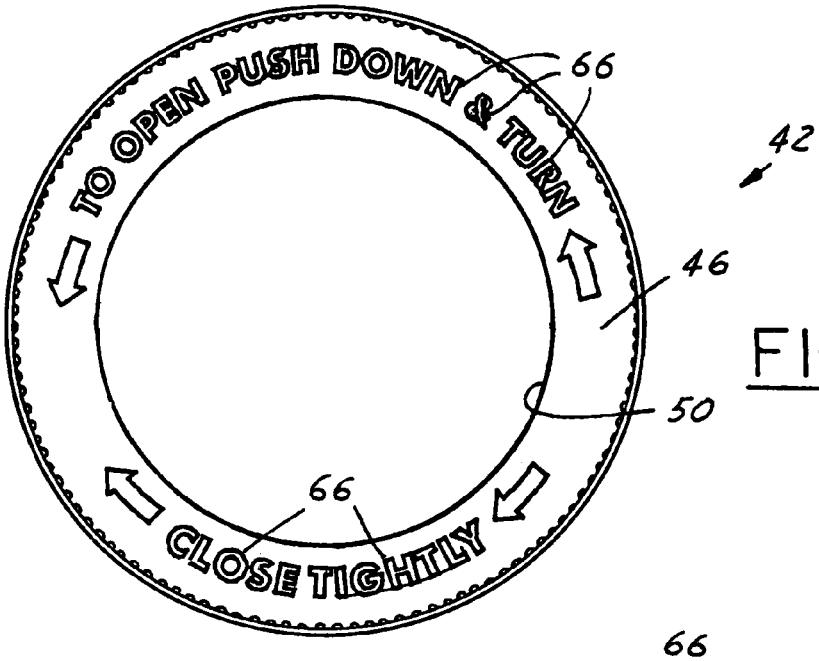
FIG. 4 is a top plan view of the outer shell in the closure of FIGS. 1-3.

To move inner shell 44 from the child-resistant position of FIGS. 1 and 2 to the non-child-resistant position of FIG. 3, and thereby convert closure 32 for operation in the non-child-resistant mode of operation, inner shell 44 is pressed downwardly with respect to outer shell 42 (or outer shell 42 is pulled upwardly with respect to inner shell 44). This may be accomplished by pushing inner shell dome 72 downwardly with respect to outer shell 42 while holding the lower edge of the outer shell. In the non-child-resistant position of inner shell 44 with respect to outer shell 42 (FIG. 3), inner shell bead 76 is captured between internal beads 60, 62 of outer shell 42. Ribs 78 on inner shell bead 76 engage ribs 64 between outer shell beads 60, 62 so that rotation of the outer shell is imparted directly to the inner shell in both clockwise and counterclockwise directions. The outer diameter of inner shell bead 76 preferably is greater than the inner diameter of inner shell bead 60 so that the inner shell is held by snap-retention in the non-child-resistant position. However, the inner diameter of lower outer shell bead 62 preferably is such that inner shell bead 76 cannot ride over outer shell lower bead 62 during application of normal forces to the inner shell with respect to the outer shell. Thus, the lesser internal diameter of lower outer shell bead 62 retains the inner shell within the outer shell when converting the closure from the child-resistant to the non-child-resistant mode of operation. The fact that lower inner shell bead 62 is circumferentially continuous helps retard circumferential expansion of this bead.

Application of extraordinary force to the inner shell, however, will overcome this retention by lower inner shell bead 62 so that inner shell 44 can be removed from within outer shell 42.

FIGS. 16-24 illustrate modified embodiments of the invention. In FIGS. 16-24, reference numerals that are identical to those used in FIGS. 1-15 indicate identical or related components. The discussion of FIGS. 16-24 will emphasize the differences between the embodiments of these figures and the presently preferred embodiment of FIGS. 1-15.

Figure 16:
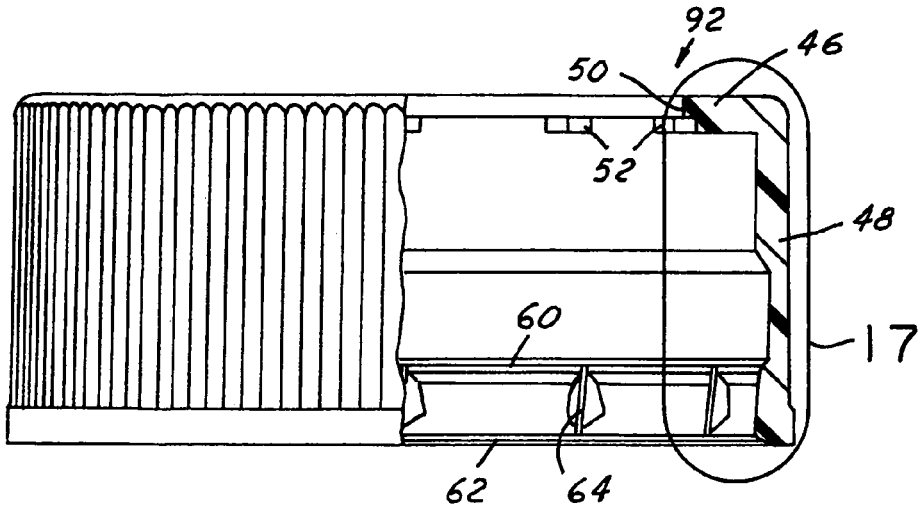
FIG. 16 is a partially sectioned elevational view which is similar to that of FIG. 5 but illustrates a modified embodiment of the closure outer shell.
Figure 17:
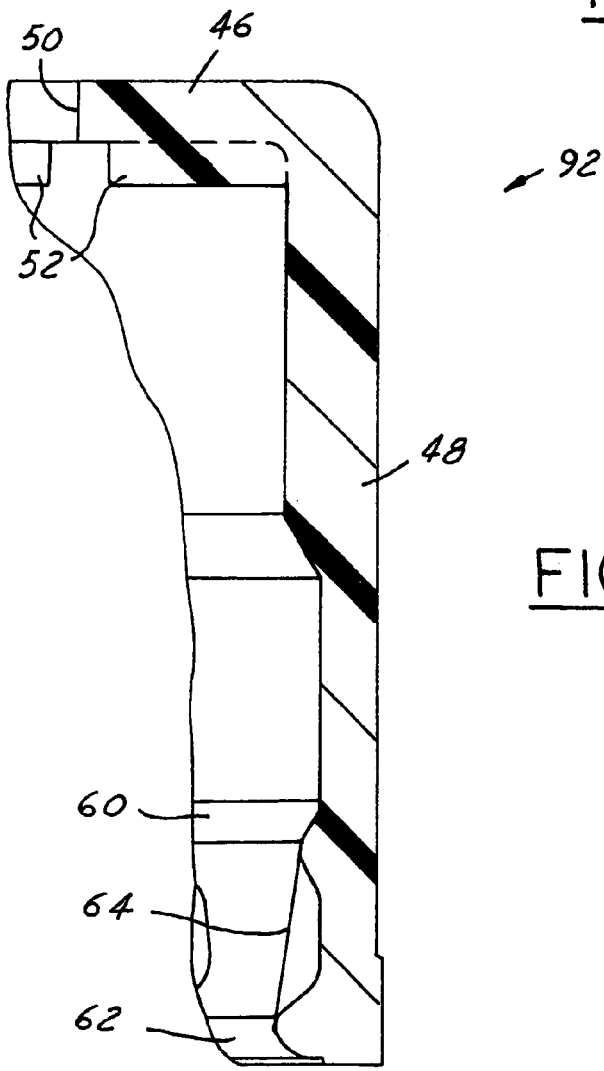
FIG. 17 is a fragmentary sectional view on an enlarged scale of the portion of FIG. 16 within the area 17.

FIGS. 16-17 illustrate an outer closure shell 92 in which circumferential spacing between ribs 64, which extend axially between upper and lower internal beads 60, 62 on skirt 48, is greater than in the embodiment of FIGS. 4-10. A greater number of ribs 64, and therefore smaller spacing between the ribs, is preferred for enhanced engagement between the inner and outer shells—i.e., to help prevent "stripping" of the outer shell with respect to the inner shell.

Figure 18:
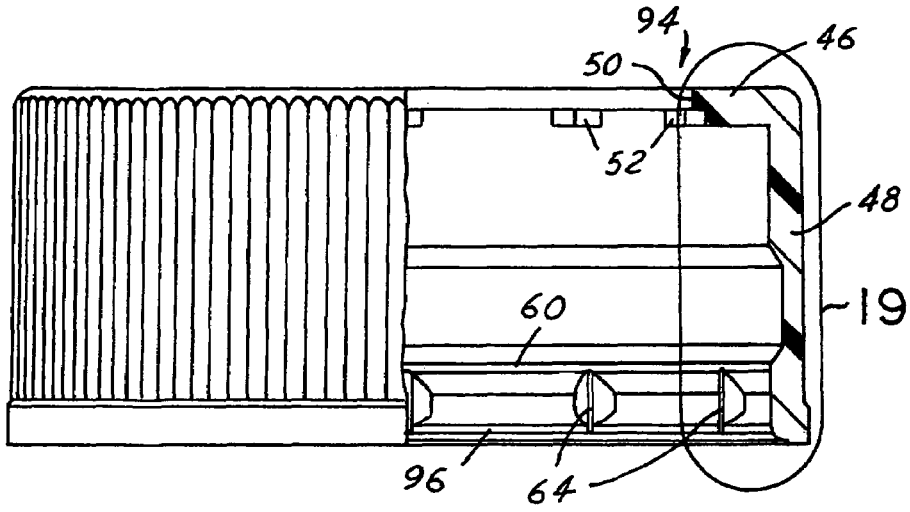
FIG. 18 is a partially sectioned elevational view which is similar to that of FIG. 5 but illustrates another embodiment of the closure outer shell.
Figure 19:
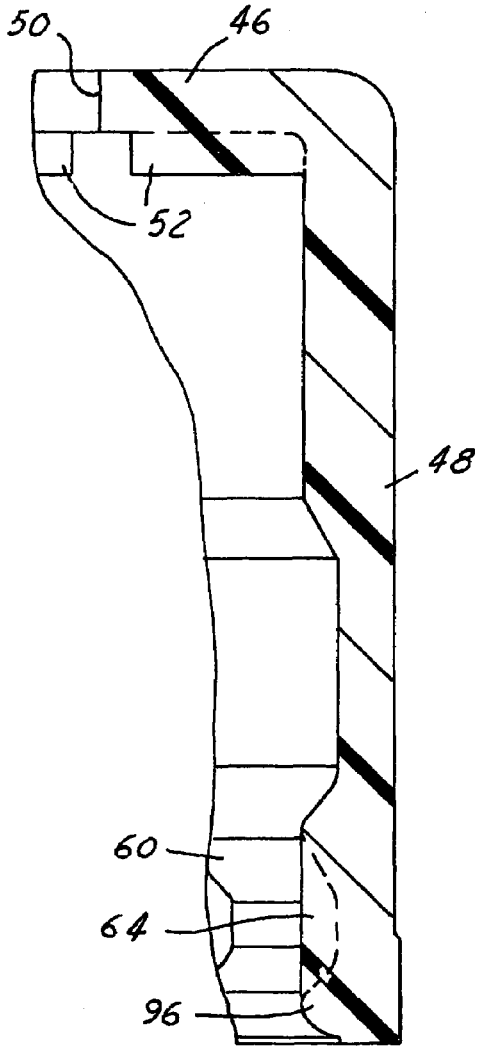
FIG. 19 is a fragmentary sectional view on an enlarged scale of the portion of FIG. 18 within the area 19.

FIGS. 18 and 19 illustrate an outer shell 94 in which circumferential spacing between ribs 64 is as in the embodiment of FIGS. 16-17, and in which skirt 48 has a lower internal bead 96 with the same inner diameter as upper internal bead 60. Provision of a lower internal bead having a lesser diameter than upper internal bead 60 is preferred to help retain the inner closure shell within the outer closure shell, as previously described.

Figure 20:
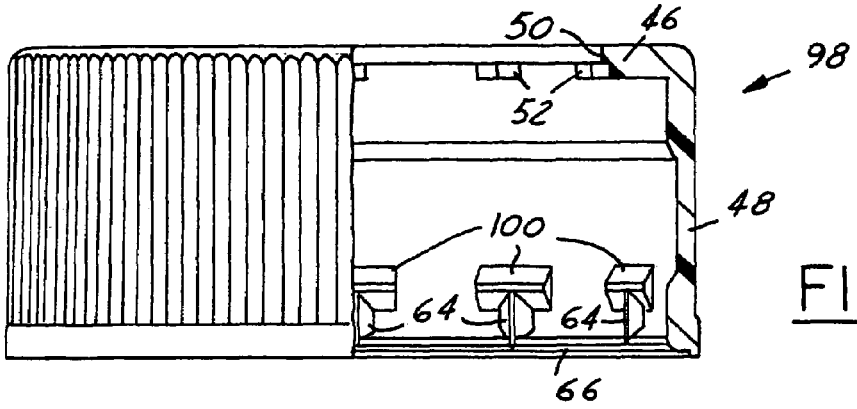
FIG. 20 is a partially sectioned elevational view which is similar to that of FIG. 5 but illustrates yet another embodiment of the closure outer shell.

FIG. 20 illustrates an outer closure shell 98 that has an upper internal bead 100 that is circumferentially segmented, as opposed to the circumferentially continuous upper internal bead 60 in the prior embodiments. Ribs 64 extend axially between each segment of bead 100 and the lower internal bead 96 on skirt 48.

Figure 21:
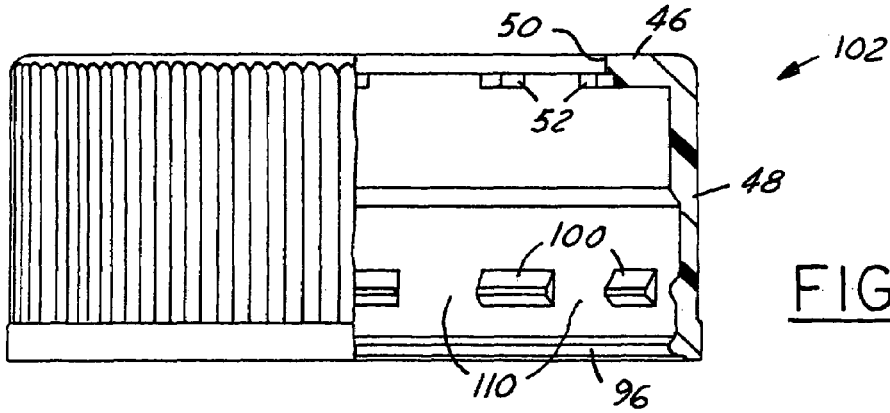
FIG. 21 is a partially sectioned elevational view which is similar to that of FIG. 20 but illustrates a further embodiment of the closure outer shell.
Figure 22:
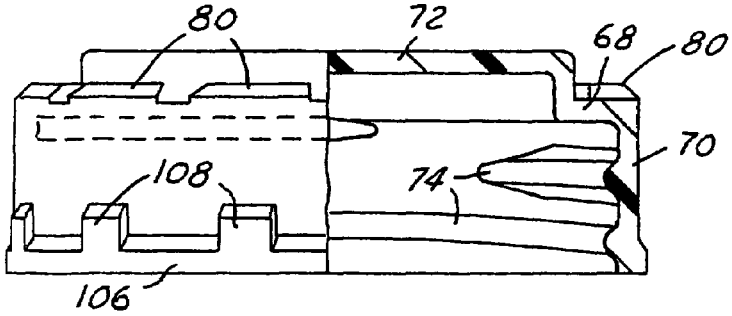
FIG. 22 is a partially sectioned elevational view which is similar to that of FIG. 12 but illustrates a modified embodiment of the closure inner shell that is useful in conjunction with the outer shell of FIG. 21.

FIGS. 21 and 22 illustrate a closure outer shell 102 and a closure inner shell 104 that form a modified closure assembly in accordance with the invention. Upper internal bead 100 is circumferentially segmented as in the embodiment of FIG. 20. External bead 106 on inner shell 104 is circumferentially continuous, and has a circumferential series of legs 108 that extend axially upwardly from bead 106 along the outer surface of skirt 70. In the non-child-resistant mode of operation, with external bead 106 of inner shell 104 captured between internal beads 100, 96 of outer shell 102, legs 108 extend into the gaps 110 between segments of bead 100 rotationally to couple outer shell 102 to inner shell 104.

Figure 23:
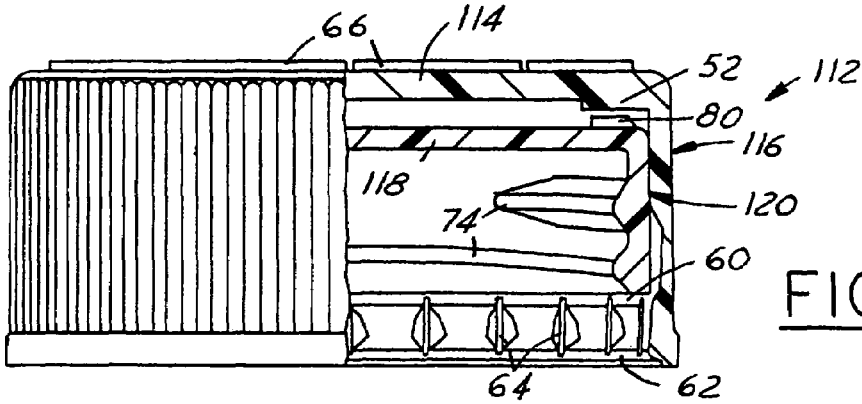
FIGS. 23 and 24 are partially sectioned elevational views which are similar to those of FIGS. 2 and 3 but illustrate a further modification to the closure of the present invention.
Figure 24:
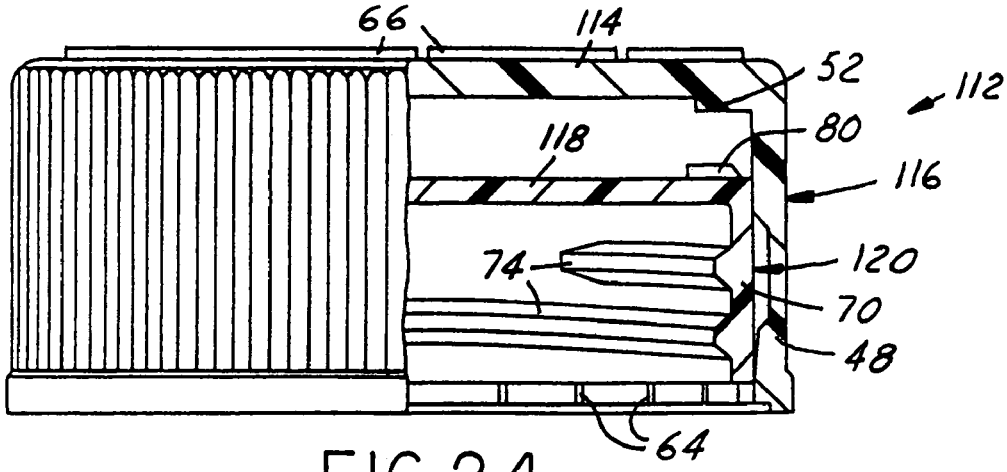

FIGS. 23 and 24 illustrate a closure 112 in a child-resistant (FIG. 23) and a non-child-resistant (FIG. 24) mode of operation. Closure 112 is essentially the same as closure 32 in the embodiment of FIGS. 1-15, except that base wall 114 of outer shell 116 has no central opening, and base wall 118 of inner shell 120 has no projection or dome. If closure 112 is initially provided to a consumer in a child-resistant mode of operation (FIG. 23), the closure may be converted to the non-child-resistant mode of operation (FIG. 24) by threading the closure onto a container and pulling outer shell 116 axially upwardly with respect to the container until the outer bead on inner shell 120 snaps between inner beads 60, 62 on outer shell 116. To convert the closure from the non-child-resistant mode of operation (FIG. 24) to the child-resistant mode of operation (FIG. 23), outer shell 116 may be pushed downwardly with respect to inner shell 120 while the closure is on a container, or inner shell 120 may be pushed upwardly within outer shell 116 by hand with the closure disassembled from a container.

Figure 25:
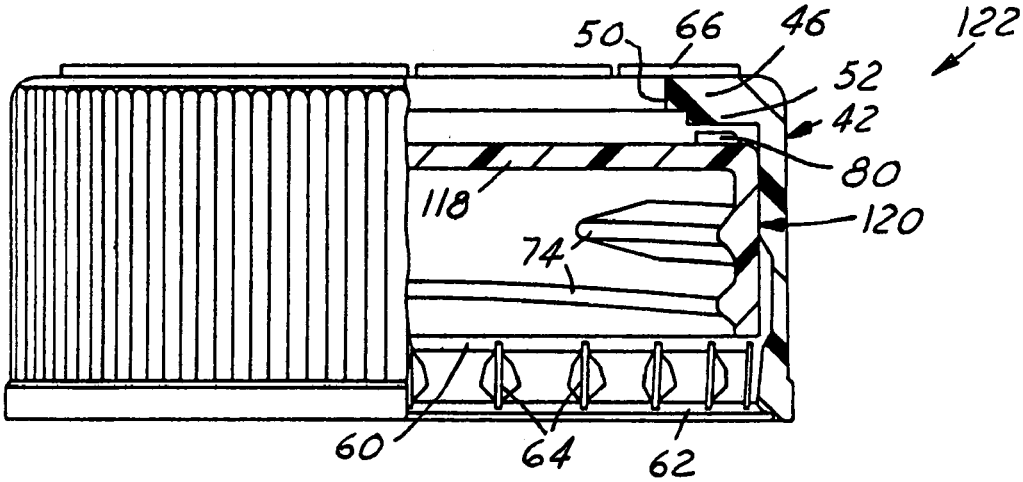
FIG. 25 is a partially sectioned elevational view that illustrates a modification to the embodiment of FIGS. 23-24.

FIG. 25 illustrates a closure 122 that includes the inner shell 120 from the embodiment of FIGS. 23-24 and the outer shell 42 from the embodiment of FIGS. 1-15. Outer shell 42 has an opening 50 in base wall 46 that can be used to move inner shell 120 for the child-resistant position shown to the non-child-resistant position.

Figure 26:
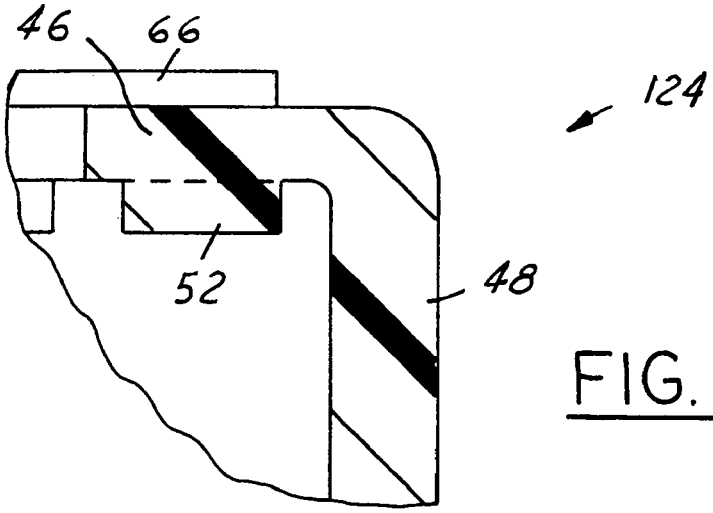
FIG. 26 is a partially sectioned elevational view that illustrates a modification to the embodiment of FIGS. 1-15.

FIG. 26 illustrates a closure outer shell 124, in which the lugs 52 terminate radially inwardly on the underside of the skirt. This modification can be implemented in any of the embodiments discussed above.

There has thus been disclosed a child-resistant closure that is readily convertible to a non-child-resistant mode of operation. The closure fully satisfies all of the objects and aims previously set forth. The closure has been disclosed in conjunction with a number of presently preferred embodiments, and additional modifications and variations have been described. Other modifications and variations will readily suggest themselves to persons of ordinary skill in the art. The invention is intended to embrace all such modifications and variations as fall within the spirit and broad scope of the appended claims.

The invention claimed is:

1. A closure that includes:

an outer plastic shell having an annular base wall, a skirt with a central axis extending from an outer peripheral edge of said base wall, a circumferential array of lugs on an underside of said base wall, a pair of axially spaced internal beads on said skirt spaced from said base wall, and an opening defined by an inner peripheral edge of said base wall, an inner plastic shell having an annular base wall, a skirt with a central axis extending from an outer peripheral edge of said base wall, at least one internal thread on said skirt of said inner shell, a circumferential array of lugs on an outer surface of said base wall, a circumferential external bead on an outer surface of said skirt adjacent to an edge of said skirt remote from said base wall, and a dome extending from an inner peripheral edge of said base wall coaxially and oppositely from said skirt, said inner shell being positionable within said outer shell in a non-child-resistant first position with said external bead on said skirt of said inner shell captured between said internal beads on said skirt of said outer shell and said outer shell rotatably coupled to said inner shell so that said at least one internal thread on said skirt of said inner shell can be threaded onto and off of a container by rotation of said outer shell, said inner shell being positionable within said outer shell in a child-resistant second position with said dome extending into said opening, and with said external bead on said inner shell skirt spaced from said internal beads on said outer shell skirt such that rotation of said outer shell is imparted to said inner shell by engagement of said lugs on said base walls, the internal bead further from said base wall of said outer shell having a lesser internal diameter than the internal bead closer to said base wall of said outer shell to retard removal of said inner shell from within said outer shell in said non-child-resistant first position of said inner shell, said outer shell including ribs extending entirely between said internal beads, and said inner shell including ribs on said external bead for engagement with said ribs on said outer shell in said non-child-resistant first position of said inner shell, said ribs on said outer shell having radially inner edges that blend with innermost edges of said internal beads and being angulated between said internal beads with respect to said central axis of said outer shell.

2. The closure set forth in claim 1 wherein said lugs on said outer shell extend radially along said underside of said base wall of said outer shell and have radially outer ends spaced from said skirt of said outer shell such that said lugs do not touch said skirt of said outer shell.

3. The closure set forth in claim 2 wherein said lugs on said base wall of said inner shell are C-shaped as viewed from an axial direction, having clockwise facing legs with angulated cam surfaces and counterclockwise facing legs with circumferentially facing abutment surfaces.

* * * * *